United States Patent [19]

Kobayashi et al.

[11] Patent Number: 4,912,302

[45] Date of Patent: Mar. 27, 1990

[54] FURNACE FOR SINTERING CERAMICS, CARBON HEATER USED THEREFOR AND PROCESS FOR SINTERING CERAMICS

[75] Inventors: Kazuo Kobayashi; Shigeru Hanzawa, both of Nagoya, Japan

[73] Assignee: NGK Insulators, Ltd., Nagoya, Japan

[21] Appl. No.: 180,064

[22] Filed: Apr. 11, 1988

[30] Foreign Application Priority Data

May 30, 1987 [JP] Japan ..... 62-133341
Jun. 1, 1987 [JP] Japan ..... 62-134960

[51] Int. Cl.[4] ..... H05B 3/42

[52] U.S. Cl. ..... 219/390; 501/99; 219/553

[58] Field of Search ..... 219/390, 552, 553; 501/95, 99; 264/56; 373/137, 127, 114, 113

[56] References Cited

U.S. PATENT DOCUMENTS 3,079,266 2/1963 Galy ..... 501/99
3,171,720 3/1965 Shea ..... 501/99
4,080,509 3/1978 Greenewald ..... 373/63
4,117,252 9/1978 McMaster ..... 219/552
4,325,694 4/1982 Bergman ..... 219/390
4,347,431 8/1982 Pearce ..... 373/109
4,647,356 3/1987 Leroy ..... 204/294

*Primary Examiner*—Teresa J. Walberg
*Attorney, Agent, or Firm*—Arnold, White & Durkee

[57] ABSTRACT

A furnace for sintering non-oxide ceramics, particularly $Si_3N_4$, which includes a space for accommodating a ceramic shaped body, carbon heaters arranged around the ceramic shaped body in said space and heat insulating layers of carbon fiber mat that cover the inner walls of the furnace. The furnace also includes sheets composed of laminated graphite leaves having an ash content of not more than 0.3% by weight extendedly provided between the heat insulating layers and the ceramic shaped body. As the carbon heaters, those composed of a high purity graphite having a carbon content of at least 99.9980%, a silicon content of not more than 5 ppm and an iron content of not more than 9 ppm, by weight, are preferably used. A process is also disclosed which utilizes the above apparatuses to protect the shaped body from an influence of carbon fiber dusts liberating from the insulating layers during sintering.

8 Claims, 2 Drawing Sheets

FURNACE FOR SINTERING CERAMICS, CARBON HEATER USED THEREFOR AND PROCESS FOR SINTERING CERAMICS

BACKGROUND OF THE INVENTION

1. Field of the Invention

The present invention relates to furnaces for sintering ceramics, particularly non-oxide ceramics, of which inner walls are lined with heat insulating layers, and carbon heaters to be used in such furnaces. This invention further relates to processes for sintering by using such furnaces and carbon heaters, wherein shaped bodies molded with a mixture of non-oxide ceramic powdery materials and sintering aids are heated at a high temperature under an inert gas atmosphere in the furnace.

2. Description of the Prior Art

Nitride ceramic materials such as silicon nitride ($Si_3N_4$), boron nitride (BN), or the like are refractory materials and generally added with 5~10% of metal oxides (MeO), such as MgO, $Al_2O_3$ or the like, or a mixture of the metal oxides with metal nitrides, as sintering aids to promote the sintering. Further, for example, $Si_3N_4$ green bodies before sintering generally have about 40 vol % voids. Now, the mechanism of strength development of the silicon nitride during sintering is accounted as formation of a kind of FRC (Fiber Reinforced Ceramics) wherein $\beta$-type silicon nitride needle crystals are dispersed as a reinforcement in glassy phases of metal oxides added as the sintering aids, whereby excellent strength characteristics are developed.

Additionally, if an example is given of $Si_3N_4$, shaped bodies thereof are generally fired at a high temperature under an inert atmosphere, particularly, at a temperature of 1,700° C.~1,900° C. under an nitrogen gas atmosphere. A typical furnace to maintain such a high temperature stable under an inert atmosphere comprises a space for accommodating the ceramic shaped bodies, carbon heaters arranged around the ceramic shaped body in said space and heat insulating layers of carbon fiber mat that cover the inner walls of the furnace, which is further provided with a vacuum port and an inert gas feed opening. The above carbon fiber mat has an extremely large volume porosity, usually 70~95 vol. % interstices, that is, resulting in a bulk density averaging about 0.2 g/cc, to ensure its excellent heat insulating properties. Alternatively, particularly when the furnace is relatively of a small size, there may be the case where a carbon cylinder to define the shaped body accommodating space and the graphitic carbon heaters is further arranged on inner side of the carbon fiber mat.

During firing of the $Si_3N_4$ in a furnace as mentioned above, the carbon fiber mat having a bulk density of about 0.2 g/cc comes into contact with $O_2$ and $H_2O$ remaining in the furnace or a trace of oxygen, oxides or oxynitrides generating from the metal oxide containing $Si_3N_4$ shaped bodies at high temperatures, so that carbon fibers in surface layers of the mat undergo an oxidation reaction. Therefore, the carbon fibers disintegrate even though by small bits. As a result, not only heat insulating properties of the mat are gradually deteriorated whereby the life of the furnace is shortened but also characteristics of the sintered body are markedly impaired by the disintegrated carbon fiber dusts that fly and suspend in the furnace and eventually adhere to the high porous $Si_3N_4$ shaped bodies during or before sintering, and also by gases such as CO, $CO_2$ or the like formed by oxidation of the carbon dusts that diffuse and contact with the $Si_3N_4$. Namely, when the carbon fiber dusts adhere onto the high porous $Si_3N_4$ shaped bodies before or during sintering as mentioned above, the shaped bodies can draw these carbon fiber dusts inside thereof as the shaped bodies contract during sintering. The drawn-in carbon dusts react with sintering aids and metal oxides, to form CO or $CO_2$ which comes out to diffuse in the furnace atmosphere and simultaneously the metal oxides are reduced into low melting metals which vaporize. Thus, the metal oxides that are to form a glassy phase matrix are lost particularly in the surface layers, leaving skeltons behind. In the skeltonized state, the $Si_3N_4$ sintered bodies no longer have excellent characteristics, such as a high strength, high thermal shock resistance, high abrasion resistance or the like, any longer.

Further, the $Si_3N_4$ shaped bodies that contact with CO, $CO_2$, etc. formed in the furnace repeat the following reactions to lose metal oxides (MeO) rapidly:

$$Si_3N_4+MeO+CO \rightarrow Si_3N_4+CO_2+Me\uparrow$$

$$CO_2 \rightarrow CO+O$$

$$C+O \rightarrow CO$$

These reactions accelerate the abovementioned formation of the $Si_3N_4$ skelton.

In order to prevent such bad influences of the carbon fiber dusts generated from the insulating layer forming carbon fiber mats, an attempt was made wherein a carbon cylinder was arranged on the inner side of the insulating layer as mentioned above. However, it usually has a wall thickness of about 10 mm, so that if the cylinder having such a high heat capacity is put in the furnace body, an excessively large electric load is naturally applied to the heaters, increasing the consumption of the heaters. Moreover, the manufacture of such a big sized cylinder is cost- and time-consuming that it is economically disadvantageous. Additionally, carbon materials that are denser, on the one hand, are less in self-consumption so that the atmosphere in the furnace can be kept clean and, on the other hand, since such materials have so high a thermal expansion coefficient that they are low in thermal shock resistance and repeated thermal stress, so that a cylinder made thereof develops cracks through which carbon fiber dusts pass to fly, doing harm to surfaces of the $Si_3N_4$ sintered body, as described above. In order to prevent the crack development, if a cylinder made of a carbon material having a low thermal expansion coefficient is used, the aforementioned disadvantages caused by the high porosity of the material itself will still not be eliminated.

Furthermore, we the inventors, as a result of continuing assiduous efforts that went into the research of the abovementioned problems and the investigation of the causes, have found that materials of the carbon heaters have a close interrelation and mutually act with the quality of nitride ceramic sintered bodies. Namely, since conventional carbon heaters have been aimed principally at the manufacture at a lowest possible cost as far as their heat generation performance is satisfiable, the purity of the constituting material, i.e., graphite, has been given less consideration, so that those having a carbon content of about three nines, containing impurities such as silicon, iron or the like of about several hundreds of ppm have generally been employed. However, when such a carbon heater is heated at high temperatures, attacks and perforations of the graphite are commenced initiating at the sites of impurities such as silicon, iron or the like contained in the graphite and the carbon disintegrates to fly and eventually adhere to the nitride shaped bodies before or during sintering. Thus, as described above, the skeltonization of the surface layers of the sintered bodies takes place. Simultaneously with it, oxygen, oxides or oxynitrides generating from the shaped bodies adversely enter micropores formed in the heater graphite and react with carbon in the depths, to encroach and disintegrate the skeltons of the graphite, emitting carbon particles, whereby the pores are enlarged until formicary-like pores are formed on the heater members. Thus, the skeltonization due to emitting carbon of the surface layers of the sintered bodies is further promoted to accelerate the degradation of the heaters. Such a heater loses its phase balance as required for a heater material, rendering not only an accurate temperature control impossible but also surface electric current increases locally at poromeric portions, resulting in breakage in an extreme case.

Additionally, other than the above-described phenomena, a problem of a bad influence of the suspending carbon particles upon a thermocouple that functions as an important temperature control has been realized a new. Namely, in temperature measurement in a high temperature nitrogen gas atmosphere at 1,700° C.~2,000° C., a two-color pyrometer that has usually been applied to high temperatures can hardly expect an accuraey due to fluctuaton, etc. induced by convections of gases in the furnace. Accordingly, in order to prevent nitriding by nitrogen gas of tungsten, generally employed is a W/Re thermocouple that is encapsulated in a molybdenumous protective tube typically enveloping argon gas. However, the molybdenumous protective tube is carbonized, when the suspending carbon particles adhere thereto, to form MoC that is very brittle and different in thermal expansion coefficient from Mo, so that cracks develop after several firing operations. From the cracks, the enveloped argon gas leaks out and nitrogen gas enters instead, whereby the tungsten is nitrided causing a change in an electromotive force that eventually results in loss of its accurate function.

SUMMARY OF THE INVENTION

The present invention aims to solve at a stroke the abovementioed various problems.

A principal object of the present invention is to provide high quality non-oxide ceramic sintered bodies, particularly $Si_3N_4$ sintered bodies, having high strength and being extremely excellent in abrasion resistance and thermal shock resistance.

Another object is to obtain such high quality $Si_3N_4$ sintered bodies with industrial feasibility and economic advantages.

Another object is to provide a furnace for sintering $Si_3N_4$ shaped bodies, with a relatively low cost, which has a prolonged life of the furnace body, being provided with low consuming insulating layers and carbon heaters.

A further object is to prevent deterioration of carbon heaters to extend the life thereof.

Still a further object is to maintain an accurate temperature control for a long time during sintering.

The firing process of the invention to achieve the abovementioned objects is, in firing a shaped body molded with a mixture of non-oxide ceramic powder and sintering aids under a high temperature inert gas atmosphere surrounded by insulating layers composed of a carbon fiber mat, characterized in that the shaped body is protected from an influence of the insulating layers by interposing sheets composed of laminated graphite leaves having an ash content of not more than 0.3% by weight between said insulating layers and said shaped body.

The apparatus according to the present invention for firing a non-oxide ceramic shaped body is, in furnaces for sintering non-oxide ceramics comprising a space for accommodating a ceramic shaped body, carbon heaters arranged around the ceramic shaped body in said space and heat insulating layers of carbon fiber mat that cover the inner walls of the furnace, characterized in that sheets composed of laminated graphite leaves having an ash content of not more than 0.3% by weight are extendedly provided between said heat insulating layers and said ceramic shaped body.

The carbon heater according to the present invention to attain the above objects is characterized by being composed of a high purity graphite having a carbon content of at least 99.9980%, a silicon content of not more than 5 ppm and an iron content of not more than 9 ppm, by weight.

Further, the furnace according to the present invention for sintering a shaped body molded with a mixture of non-oxide ceramic powdery materials and sintering aids by heating at a high temperature under an inert atmosphere is characterized by being provided with carbon heaters composed of a high purity graphite having a carbon content of at least 99.9980%, a silicon content of not more than 5 ppm and an iron content of not more than 9 ppm, by weight, to keep the atmosphere inside the furnace clean.

In the process of the present invention, a preferable inert atmosphere is a nitrogen gas atmosphere, most preferably under pressure.

The above graphite leaf has an ash content of preferably not more than 0.2%, more preferably not more than 0.1%, by weight.

Additionally, the sheet composed of laminated graphite leaves desirably has a thickness of about 0.2~0.4 mm.

To interpose such sheet between the heat insulating layers and the shaped body, it is preferred for the sheets to be attached onto the inner surface of the heat insulating layers or, when a carbon cylinder is provided inside, onto the inner surface of the cylinder.

Further, the concept of the present invention is suitably applicable to the process as well as the apparatus for firing not only the nitride ceramics but also other non-oxide ceramics such as carbide ceramics or the like. The non-oxide ceramic the present invention can be most suitable applied to is silicon nitride.

The high purity graphite to be applied to the carbon heater of the present invention has a carbon content of preferably at least 99.9985%, more preferably at least 99.9995%, a silicon content of preferably not more than 4 ppm, more preferably not more than 2 ppm, and an iron content of preferably not more than 8 ppm, more preferably not more than 3 ppm, by weight.

Additionally, the above high purity graphite has a bulk density of preferably at least 1.75 g/cc, more preferably 1.76 g/cc.

The carbon heater of the present invention renders the best result when used in combination with the abovementioned process wherein the shaped body is protected from an influence of the insulating layers by interposing sheetings consisting of laminated graphite leaves having an ash content of not more than 0.3% by weight between said insulating layers and shaped body.

BRIEF DESCRIPTION OF THE DRAWING

The above construction and features of the present invention will be further explained in more detail with reference to the preferred embodiments taken in connection with the accompanying drawings, wherein.

DETAILED DESCRIPTION OF THE INVENTION

Figure 1:
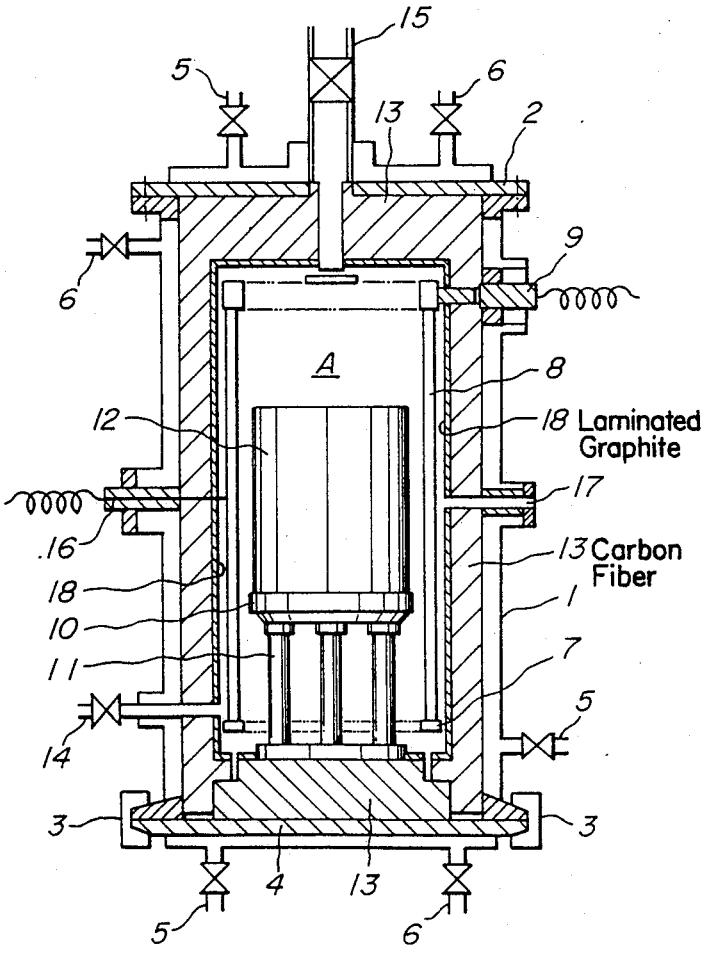
FIG. 1 is a vertical cross-sectional view illustrating an embodiment of the furnace according to the present invention for sintering silicon nitride.

In FIG. 1, a furnace body is comprised of a vertical cylinder 1 having a cylindrical, prismatic or other outline, provided with an upper lid 2 that hermetically closes the top end of the cylinder and a lower lid 4 that is releasably fixed with clamps 3 on the bottom end of the cylinder. The cylinder, the upper lid and the lower lid are provided with a water jacket, respectively, which has a cooling water inlet 5 and a cooing water outlet 6. Graphitic carbon heaters 8 supported by a heater supporting member 7 are arranged around a shaped body accommodated in space A in the center of the furnace and connected with an electric source via a heater terminal 9. Further, on the lower lid 4, a table 10 is supported with rods 11, on which a shaped body 12 is loaded. Each inner wall surface of the cylinder, upper lid and lower lid is covered and thermally shielded by an insulating layer 13 composed of a carbon fiber mat. An exhaust conduit 14 is connected with an evacuating device such as a vacuum pump (not shown), and an inert gas, e.g., nitrogen gas, supply conduit 15 is connected with a pressurized inert gas supply device. Additionally, the furnace body is usually equipped with a thermocouple 16 and a sight hole 17 for measuring, controlling and monitoring temperature conditions, etc., during operation.

In a furnace for sintering silicon nitride as mentioned above, the apparatus applied to the present invention, in particular, is provided with graphite sheets 18 interposed between the shaped body 12 and the heat insulating layer 13, preferably covering uniformly all over the inner surfaces of the heat insulating layers, to intercept a free communication between the atmosphere surrounding the shaped body 12 and the atmosphere along the vicinity of the heat insulating layers 13. In the embodiment shown in FIG. 1, such sheets are provided extending all over the inner surfaces of the heat insulating layers. However, in the case where a carbon cap or cylinder enclosing the space A accommodating the graphite heaters 8 together with the shaped body is provided (not shown), it is preferred that the above sheets are attached throughout the length and breadth of the inner wall of the cap or cylinder.

However, the graphite sheets according to the present invention are attached not necessarily extending all over the inner wall surfaces throughout the length and breadth thereof. It is apparent that only to attach to a portion where the heat insulating layer of carbon fiber mat is otherwise intensely worn, namely, a portion near the heaters, can exert an appreciable effect.

The above graphite sheet is composed of laminated high purity graphite leaves. Each leaf is formed from graphite that has been subjected to a high purification treatment to reduce the ash content to not more than 0.3%, preferably not more than 0.2%, more preferably not more than 0.1%, by weight, in order to suppress impurities generating from the graphite itself at high temperatures to a minimal amount. Such a sheet can withstand temperatures of at least about 2,500° C. under a nitrogen gas atmosphere.

The amount of the ash this graphite sheet contains has a close relation with the life of the graphite sheet in the case of repeated use at a temperature of about 2,000° C. When the ash content is 0.3% or less, preferably 0.1% or less, the life of the furnace materials is advantageously prolonged.

It is preferred that the sheet has a thickness of about 0.2 mm~0.4 mm. If too thin, it becomes so deficient in strength that a fear of breaking arises when it is attached or installed extending, while, if too thick, machinability will undesirably decrease.

To attach the above sheet to the inner surfaces of the heat insulating layers, it may be fastened by sewing with carbon fiber threads or adhered with special carbon adhesives. However, because of the feasible and simplified work, it is most preferred to use a heat resistant carbon fastening material as proposed by the present inventors in Japanese Utility Model Registration application No. 62–80,942, namely, a pin formed from graphite integrally into a whole body composed of a large diametric disc-like member having a flat lower contact surface and a small diametric rod-like fastener member extending vertically from the center of said contact surface.

Figure 2:
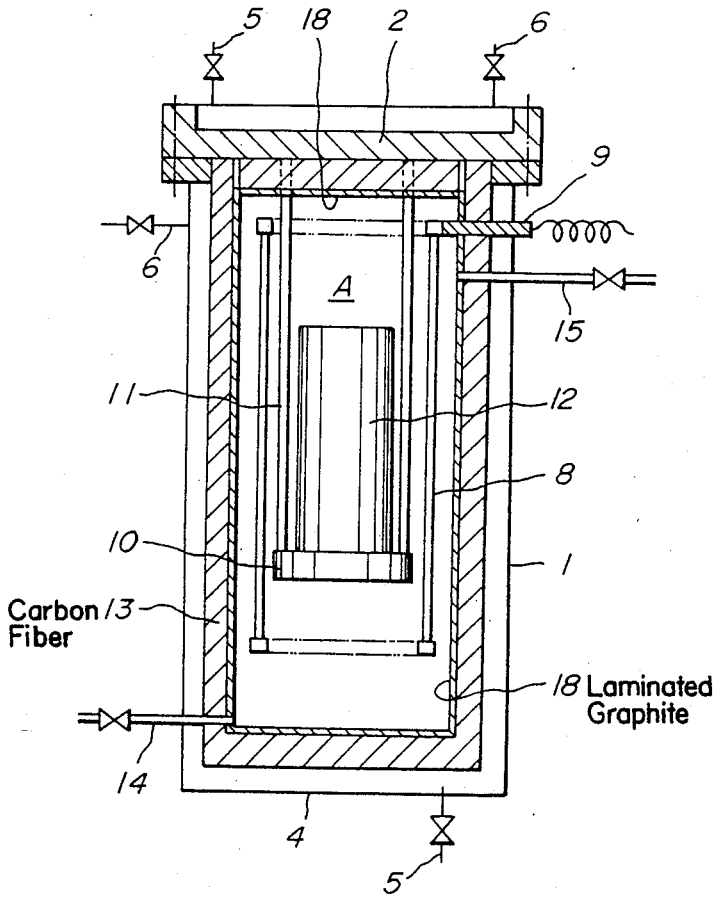
FIG. 2 is a schematic vertical cross-sectional view illustrating a different embodiment of the furnace according to the present invention.

FIG. 2 is also a vertical cross-sectional view illustrating a modification of the embodiment shown in FIG. 1, wherein the same parts are designated by same numbers. The apparatus shown in FIG. 2 has a structure substantially same as that in FIG. 1, except that the upper lid 2 is releasably fixed to the cylinder 1 and the table 10 to be loaded with the shaped body 12 is suspended with rods 11 from the upper lid 2.

Besides the above, various alterations and modifications in design may be made, including the mechanism for loading and unloading the shaped bodies, without departing from the basic inventive concept and the scope of claims of the present invention.

The functions of the apparatus and process according to the present invention will be explained hereinafter with reference to the furnace shown in FIG. 1.

At the outset, releasing the engagement of the clamp 3, the lower lid 4 is taken off together with the table 10 loaded thereon from the cylinder 1 and descended by means of a lift or the like. After an $Si_3N_4$ shaped body 12 containing metal oxide sintering aids that has been molded according to a conventional method is placed on the table 10, the lower lid is ascended again to put the above shaped body into the furnace and fixed to the cylinder with the clamp 3. Then, the vacuum pump is operated to evacuate air inside the furnace through the air exhaust conduit 14 and then an inert gas, preferably nitrogen gas, is fed in through the inert gas supply conduit 15 to replace the atmosphere inside the furnace by nitrogen gas. In this condition, a voltage is applied via the terminal 9 to the graphitic carbon heater 8, to raise the furnace internal temperature up to about 1,700° C.~1,900° C. that is kept for about 1 hour to effect sintering. During the sintering, the furnace walls, since shielded with the heat insulating layers 13 and further covered by the water jackets, are kept at a safe temperature of at most several hundred degrees.

During sintering at a high temperature, a trace of oxygen, oxides, oxynitrides or the like liberated from the sintering aids and/or silicon nitride is blocked by barriers of the graphite sheets 18 and prevented from contact with poromeric, high temperature oxidizable, carbon fiber insulating layers. Alternatively, fibrous dusts such as carbon fiber fine fibrils formed by breaking and disintegrating by virture of the action of a trace of surface oxygen originally held by the heat insulating layer constituting carbon fibers or oxygen incidentally entering through the above barriers, are confined by the graphite sheets 18 within the vicinity of the furnace walls, so that the flying and floating fibrous dusts never come out through the sheets to the inner side to contact with the shaped bodies.

Additionally, since the graphite sheet itself is composed of a high purity graphite having an extremely reduced ash content, impurities such as oxygen or metal oxides generating from the sheet are limited in an amount within a virtually harmless range, so that the shaped body accommodating space is kept under a very clean atmosphere. Thus, the wearing of the sintering aids decreases markedly and virtually no skeltonization of the $Si_3N_4$ takes place. Consequently, a high quality $Si_3N_4$ sintered body wherein $Si_3N_4$ needle crystals are uniformly dispersed in glassy phases of sintering aids up to the surface layers can be obtained.

Further, as to carbon heaters to be used in furnaces, conventional ones have generally been fabricated by the steps of: kneading a carbon material comprising pulverized coke, etc., admixed with pitch, etc., to form a paste; extruding or injection-molding the paste into a rod-like structure; and graphitizing by firing the rod-like structure with a desired shape. Such graphite materials, on the one hand, have been extensively used because they are manufacturable at the lowest cost and provided with an ability to achieve a required high temperature. However, on the other hand, they are appreciably high in ash content including silicon and iron and, moreover, low in density such as about 1.65 g/cc, which have constituted main causes for the abovementioned problems.

As graphite materials to be applied to the carbon heaters according to the present invention, suitable ones are fabricated by graphitization through firing according to a conventional method of a body material which has been molded not by anisotropic molding, for example, extrusion-molding, injection-molding, etc., but by isotropic molding by means of a die molding, more preferably a cold isotropic press (CIP) molding, followed by a high purification treatment wherein heating is conducted under an inert gas atmosphere introducing a halogen gas thereinto, to eliminate impurities.

The graphite material obtained by the abovementioned process is applied to the carbon heaters according to the present invention, which has a carbon content of at least 99.9980%, preferably at least 99.9985%, more preferably at least 99.9995%, by weight, and in its impurities, a silicon content of not more than 5 ppm, preferably not more than 4 ppm, more preferably not more than 2 ppm, and an iron content of not more than 9 ppm, preferably not more than 8 ppm, more preferably not more than 3 ppm, by weight. If the carbon content is less than 99.9980% and the silicon content and iron content exceed 5 ppm and 9 ppm, respectively, improvements in surface strength and antioxidation property of the sintered body are not substantially recognized and elongation of the life of the heater as well as prevention of the deterioration of the thermocouple are not achievable. Additionally, the aforementioned isotropic molding process can provide a graphite material with a density of 1.75 g/cc or more, which is desirable for the carbon heater according to the present invention. If the density is too low, it is not preferred because opportunities for oxygen, oxides, etc. to enter between graphite molecules increase.

The carbon heaters made of such a high purity graphite material are suitably applicable to a furnace for sintering non-oxide ceramics, such as not only nitride ceramics but also carbide ceramics or the like, and further can be advantageously employed in a furnace for growing Si single crystals, etc.

In the aforementioned case where the heat insulating layers of carbon fiber mat are provided on inner wall surfaces of the furnace, it is most preferable to apply the carbon heaters of the present invention together with the graphite sheets interposed between the shaped body to be fired and the heat insulating layers, preferably throughout the length and breadth of the heat insulating layers, to intercept a free communication between the atmosphere surrounding the shaped body and the atmosphere along the vicinity of the heat insulating layers.

By applying the above high purity graphite material to the carbon heaters, liberation and flying of the carbon particles caused by disintegration, poromerization, etc. of the graphite itself are decreased, whereby the internal atmosphere of the furnace can be kept very clean.

The process for firing non-oxide ceramics by using such carbon heaters will be further explained.

Nitride powder such as $Si_3N_4$, BN or the like admixed with metal oxide sintering aids is molded by means of a cold isotropic press molding such as die molding, rubber pressing or the like, to form shaped bodies. The furnace is loaded with the thus fabricated shaped body, of which the internal atmosphere is replaced by an inert gas, particularly nitrogen gas, and pressurized to increase the partial pressure of the gas, if required. Under such conditions, a voltage is applied to the carbon heaters to raise the internal temperature of the furnace to at least about 1,700° C. and below the sublimating temperature of the nitride, usually up to about 1,800° C., which temperature is kept for 1 hour to effect sintering.

In the present invention, the use of the carbon heaters composed of a high purity graphite material having an extremely high carbon content and very low impurity content noticeably decreases liberation and flying-out of carbon fine particles from the graphite during sintering at a high temperature. Accordingly, the formation of formicary-like pores in the graphite itself of the heaters is virtually prevented and so the internal atmosphere of the furnace that contacts with the shaped body is kept in a clean condition that contains extremely reduced carbon particles. Therefore, the wearing of the sintering aids due to drawing-in by shaped body of the carobn particles is prevented and the skeltonization of the nitrides also noticeably decreases, so that a high quality nitride sintered body wherein nitride needle crystals are dispersed uniformly in glassy phases of the sintering aids up to the surface layers of the sintered body is obtained. Additionally, since generation of gases such as oxygen, oxides or the like from the shaped body during the sintering is suppressed a great deal, virtually no attack on the graphite is induced and even if extremely small quantities of these generating gases contact with surfaces of the dense graphite, they cannot enter into the depths, so that disintegration of the graphite skelton decreases and the heaters can remain in a good condition for a long period of time.

In sintering $Si_3N_4$, its shaped bodies are generally encased in SiC crucibles, $Si_3N_4$ crucibles or carbon crucibles having SiC densely deposited surfaces and then fired. It is because of an effect of the crucibles to suppress an influence exerted by carbon fiber dusts existing in the furnace, liberated from insulating layers, or by gases such as CO, $CO_2$ or the like generating by decomposition of the heater material. Additionally, the crucibles fill the role of firing the sintered bodies with high efficiency in a geometrically piled up state. Needless to say, also in the case where such crucibles are employed, the present invention can afford the same effect. It is additionally noted that, when the crucibles are made of $Si_3N_4$, etc., the present invention exerts an effect in respect of extending the life of the crucibles by preventing their skeltonization.

The present invention will be further explained by way of example. In the following example, "percent" and "part" are all by weight.

The ash content in the graphite sheeting was determined in accordance with JIS R 7223, namely, a method wherein the sheeting specimen was put into a platinum crucible, and after igniting at 800° C. in an oven, the remaining ash was weighed.

EXAMPLE 1

To 90% of powdery $Si_3N_4$, were added 1% of SrO, 4% of MgO and 5% of $CeO_2$ as sintering aids, and after mixing thoroughly, the mixture was molded using a mold press into a plate of 10 mm×60 mm×60 mm. A furnace as shown in FIG. 1 was loaded with the above plate, whose internal atmosphere was replaced by $N_2$ gas and then kept at 1,700° C. for 1 hour to sinter the plate. Graphite sheetings were attached to all over inner surfaces of heat insulating layers composed of carbon fiber felt in the furnace. The graphite sheets were fabricated by laminating graphite leaves and adhering to each others with graphitic adhesive V58*a* (manufactured by SIGRI, West Germany), followed by firing in nitrogen gas at about 600° C. The graphic sheetings had a thickness of about 0.4 mm and an ash content of 0.1%.

EXAMPLE 2

An $Si_3N_4$ sintered body was obtained in the same manner as the above Example 1 except that the graphite sheetings were not attached on to the inner surfaces of the heat insulating layers but to all over inner wall surfaces of a graphite cylinder (a bulk density of 1.75 g/cm$^3$, and a wall thickness of 5 mm) that was arranged so as to enclose the carbon heaters 8 and the shaped body 12 in the furnace.

EXAMPLE 3

An $Si_3N_4$ sintered body was obtained in the same manner as the above Example 1 except that the graphite sheets had an ash content of 0.3%.

COMPARATIVE EXAMPLE 1

An $Si_3N_4$ sintered body was obtained in the same manner and with the same apparatus as the above Example 1 except that the graphite sheets were not attached.

COMPARATIVE EXAMPLE 2

An $Si_3N_4$ sintered body was obtained in the same manner and with the same apparatus as the above Example 2 except that the graphite sheets were not attached.

Characteristics of the sintered bodies obtained in the above Examples and Comparative Examples are shown altogether in Table 1 below.

TABLE 1

| | Properties | | | | |
|---|---|---|---|---|---|
| Example No. | Weight loss of Sintered body (%) | Flextural Strength of Sintered Surface (kgf/mm$^2$) (Surface/core) | Oxidation** Resistance (mg/cm$^2$) (1000° C./1000 hr) | Spewing of* Fluorescent Flaw Detecting Solution | Life of*** Graphite Sheet |
| Example 1 | 0.5 | 75/88 | 0.06 | O | more than 200 times |
| Example 2 | 0.3 | 79/88 | 0.05 | O | more than 200 times |
| Example 3 | 0.8 | 72/88 | 0.09 | O | about 80 times |
| Comparative Example 1 | 2.0 | 61/86 | 0.30 | x | |
| Comparative Example 12 | 1.6 | 62/86 | 0.28 | Δ | |

*The specimen was soaked in a fluorescent agent organic solvent solution and washed with water. Then, the degree of spewing-out of the fluorescent agent was observed with a black light lamp.
Evaluated grade:
O . . . substantially no spewing.
Δ . . . spotted spewing.
x . . . spewed over entire surface.
**The gain in weight per unit surface area after heating at 1,000° C. for 1,000 hours in air.
***Frequency of operations for the life of the furnace when silicon nitride was sintered at about 1,800~2,000° C. under an inert gas atmosphere (number of firing operation until the graphite sheet attached to the furnace wall peeled off).

As is clear from the above Table 1, it has been exemplified that the $Si_3N_4$ sintered body obtained according to the process of the invention is very low in percent weight loss and wearing of sintering aids of the sintered body as compared with conventional articles. This means the fact that virtually no skeltons of $Si_3N_4$ are formed which is also proved by the result showing that the sintered body according to the invention is extremely high in flexural strength of the sintered surface as compared with conventional ones. Additionally, the sintered body according to the invention is extremely stable against a high temperature oxidation reaction, and the fluorescent flaw detection has demonstrated it has a dense and substantially void-free texture. Thus, its excellence in abrasion resistance and thermal shock resistance is understood.

Further, when the graphite sheets have an ash content of 0.3%, though the life of the furnace is relatively short, a good silicon nitride sintered body is obtainable.

It has been found that the ash content of the graphite sheets according to the present invention exerts a significant function on the characteristics of the sintered body, and an effect of the combined use of a graphite cylinder is also excellent.

EXPERIMENTAL EXAMPLE

The cause of the deterioration of carbon heaters has so far been accounted as an action of oxygen contained in the ambient gas. The following experiment was conducted to confirm the above.

Nitrogen gas was selected as the ambient gas. Admixing a very small quantity of oxygen, two kinds of nitrogen gas having a purity of 99.999% and 99.90%, respectively, were prepared. Under respective nitrogen gas atmospheres, heating at about 1,800° C. for 1 hour with a carbon heater was repeated 100 times and in both cases no significant difference in state of deterioration was observed between two carbon heaters used in the different atmospheres.

EXAMPLES 4~8

Ninety % of $Si_3N_4$ powdery material, 1% of $SrO_2$, 4% of MgO and 5% of $CeO_2$ were mixed and molded with a die-pressing machine into a square plate $Si_3N_4$ molded specimen of 6 mm×60 mm×60 mm. A furnace having an inside diameter of 400 mmΦ and a height of 1,000 mmH was loaded with the above specimen and kept at 1,700° C. under nitrogen gas partial pressure of 1 atm. for 1 hour to effect firing.

The above firing was conducted for each of carbon heaters composed of six kinds of graphite materials, respectively, shown in Table 2 below. Impurity elements were measured by atomic-absorption spectroscopy.

TABLE 2

| Heater No. | C-content (%) | Si (ppm) | Fe (ppm) | Other impurities | Density (g/cc) | Molding method |
|---|---|---|---|---|---|---|
| 0 | 99.9 | 400 | 400 | Al, V, Ca, etc. | 1.65 | Extrusion |
| 1 | 99.998 | 5 | 9 | " | 1.65 | Extrusion |
| 2 | 99.998 | 5 | 9 | " | 1.76 | CIP |
| 3 | 99.9985 | 4 | 6 | " | 1.75 | CIP |
| 4 | 99.9985 | 3 | 8 | " | 1.77 | CIP |
| 5 | 99.9995 | 2 | 3 | " | 1.76 | CIP |

The result of the investigation of characteristics of the sintered body fired using each heater is shown in Table 3 below.

TABLE 3

| Example No. | Heater No. | 4-point Bending Strength (kgf/mm²) Surface/Core | Ratio | Oxidation** Resistance (mg/cm²) | Spewing of* Fluorescent Flaw Detecting Solution |
|---|---|---|---|---|---|
| Comparative Example 3 | 0 | 52/88 | 0.59 | 0.23 | X |
| Example 4 | 1 | 64/85 | 0.75 | 0.14 | Δ |
| Example 5 | 2 | 65/88 | 0.74 | 0.14 | Δ |
| Example 6 | 3 | 67/89 | 0.75 | 0.10 | O |
| Example 7 | 4 | 69/88 | 0.78 | 0.12 | O |
| Example 8 | 5 | 69/90 | 0.77 | 0.08 | O |

The asterisks * and ** mean the same as the footnotes of Table 1.

As is clear from the result shown in Table 3, the $Si_3N_4$ sintered body obtained according to the present invention is extremely high in flexural strength of the sintered surface as compared with the conventional one. Additionally, the sintered body according to the invention is extremely stable against a high temperature oxidation reaction. The fluorescent flaw detection has demonstrated it has a dense and substantially void-free texture. Thus, its excellence in abrasion resistance and thermal shock resistance is understood.

Particularly, the $Si_3N_4$ sintered body obtained by Comparative Example 1 wherein heater No. 1 was used had a color shade difference such that surfaces exhibited a white shade and interior portions several millimeters inside from the surface became dark grey, and the surface layers had been skeltonized.

Additionally, it has been found that the carbon content and impurity content of the graphite sheetings according to the present invention exert a significant function on the characteristics of the sintered body.

EXAMPLES 9~13

$Si_3N_4$ sintered bodies were obtained in the same manner as the above Examples 4~8 and Comparative Example 3, except that the nitrogen gas partial pressure was 10 atm. and the sintering temperature was 1,750° C. The results are shown in Table 4 below.

TABLE 4

| Example No. | Heater No. | 4-point Bending Strength (kgf/mm²) Surface/Core | Ratio | Spewing of Fluorescent Flaw Detecting Solution |
|---|---|---|---|---|
| Comparative Example 4 | 0 | 55/87 | 0.63 | X |
| Example 9 | 1 | 63/87 | 0.72 | Δ |
| Example 10 | 2 | 68/89 | 0.76 | O |
| Example 11 | 3 | 67/84 | 0.80 | O |
| Example 12 | 4 | 70/89 | 0.79 | O |

TABLE 4-continued

| Example No. | Heater No. | 4-point Bending Strength (kgf/mm²) Surface/Core | Ratio | Spewing of Fluorescent Flaw Detecting Solution |
|---|---|---|---|---|
| Example 13 | 5 | 72/86 | 0.84 | O |

As is clear from the comparison of the results in Table 4 with those in Table 3, the strength of the sintered bodies further improves when the ambient nitrogen gas partial pressure is increased and the sintering temperature is raised.

EXAMPLES 14~18

Using carbon heaters composed of 6 kinds of graphite materials, respectively, shown in Table 2, sintering of $Si_3N_4$ at a sintering temperature of 1,800° C. under a nitrogen gas partial pressure of 10 atm. for 1 hour was repeated. The durabilities of the heaters and thermocouples were studied. The result was as shown in Table 5 below.

TABLE 5

| Heater No. | Frequency of Firing before Heater Exchange | Frequency of Firing before Thermocouple Exchange |
|---|---|---|
| 0 | 30 | 10 |
| 1 | 55 | 20 |
| 2 | 65 | 25 |
| 3 | more than 110 | 35 |
| 4 | more than 110 | 35 |
| 5 | more than 150 | 40 |

It is understood from the above Table 5 that the present invention exerts functions to conspicuously extend the life of the carbon heater itself as well as the period of time to maintain the function of the thermocouple.

As explained and demonstrated above, according to the process and apparatus of the present invention, the internal atmosphere of a furnace for firing non-oxide ceramics, particularly the $Si_3N_4$ shaped body accommodating space, is kept clean, reducing the pollution by carbon particles liberating from carbon heaters, so that skeltonization of $Si_3N_4$ caused by wearing of sintering aids on surfaces of the sintered bodies is prevented to yield uniform and high quality $Si_3N_4$ sintered bodies that are high in strength and excellent in abrasion resistance and thermal shock resistance. By virtue of such improvement in quality and performance, the applicable fields of nitride ceramics are expected to be further extended and diversified.

Additionally, according to the present invention, the aforementioned objects of the invention are readily achievable only by attaching graphite sheets on to the inner surfaces of the heat insulating layers, so that a process and a furnace for sintering $Si_3N_4$ shaped bodies are provided with high industrial feasibilities and economical advantages, and materialized with far small investment and running cost as well as without increasing power consumption, as compared with conventional processes and apparatuses such as that require, for example, an expensive, large sized graphite cylinder that forces the cost to increase, e.g., due to an increase of consuming rate of heaters caused by a thermal load increase. The present invention is possible to exert excellent effects that have never been attained so far and accomplish further improvements of quality and characteristics, if such a graphite cylinder is employed in combination.

Further, the present invention also exerts effects that prevention of contact of the carbon fiber dusts generating from heat insulating layers with the $Si_3N_4$ shaped body extends the lives of heat insulating layers and carbon heaters and also extends the life of the furnace body.

Furthermore, since the present invention extends lives of expensive heaters and W/Re thermocouples and maintains good functions thereof for a long period of time, it has prominent economical advantages, rendering continuous production possible in addition to its two-bird-one-stone effect, that is, savings of expenses by virtue of exchange frequency reduction and quality homogenization resulting from stabilization of manufacturing conditions.

What is claimed is:

1. A furnace for sintering non-oxide ceramics, comprising:

furnace walls defining a space for accommodating a shaped ceramic body;

carbon heaters arranged directly around the shaped ceramic body in said space;

heat insulating layers of carbon fiber mat disposed on and covering inner surfaces of said furnace walls; and sheets consisting of laminated graphite leaves having an ash content of not greater than 0.3% by weight, said sheets being provided over said insulating layers such that said sheets protect said shaped ceramic body from exposure to said insulating layers.

2. The furnace of claim 1, wherein said shaped ceramic body consists of silicon nitride.

3. A process for firing a shaped ceramic body comprising a mixture of non-oxide ceramic powder and sintering aids, comprising:

surrounding said body with insulating layers composed of a carbon fiber mat;

protecting said body from exposure to said insulating layers by interposing sheets consisting of laminated graphite leaves having an ash content of not more than 0.3% by weight, between said insulating layers and said body; and firing said body at a high temperature in an inert gas atmosphere.

4. The process of claim 3, wherein said non-oxide ceramic consists of silicon nitride.

5. A carbon heater for firing non-oxide ceramics which contain sintering aids, comprising a high purity graphite consisting essentially of, in weight %, 99.9980% carbon, not greater than 5 ppm silicon, and not greater than 9 ppm iron.

6. The carbon heater of claim 5, wherein said graphite has a bulk density of at least 1.75 g/cc.

7. A furnace for sintering non-oxide ceramics, comprising:

furnace walls defining a space for accommodating a shaped ceramic body;

carbon heaters arranged directly around the shaped ceramic body in said space, said carbon heaters comprising a high purity graphite consisting essentially of, in weight %, 99.9980% carbon, not greater than 5 ppm silicon, and not greater than 9 ppm iron;

heat insulating layers of carbon fiber mat disposed on and covering inner surfaces of said furnace walls; and sheets consisting of laminated graphite leaves having an ash content of not greater than 0.3% by weight, said sheets being provided over said insulating layers such that said sheets protect said shaped ceramic body from exposure to said insulating layers.

8. The furnace of claim 7, wherein said non-oxide ceramic consists of silicon nitride.

* * * * *